US006666974B2

(12) United States Patent
Page

(10) Patent No.: US 6,666,974 B2
(45) Date of Patent: Dec. 23, 2003

(54) SUBGRATE DRAIN BASIN FILTER

(76) Inventor: Ardle E. Page, 1455 Center St., Albany, OR (US) 97321

( * ) Notice: Subject to any disclaimer, the term of this patent is extended or adjusted under 35 U.S.C. 154(b) by 59 days.

(21) Appl. No.: 09/991,733

(22) Filed: Nov. 20, 2001

(65) Prior Publication Data

US 2003/0098267 A1 May 29, 2003

(51) Int. Cl.[7] ..... E03F 5/06

(52) U.S. Cl. ..... 210/747; 210/164; 210/434; 210/474; 210/170; 404/5

(58) Field of Search ..... 210/162, 163, 210/164, 170, 474, 477, 434, 747, 767; 404/4, 5

(56) References Cited

U.S. PATENT DOCUMENTS

| | | | | |
|---|---|---|---|---|
| 1,746,121 | A | | 2/1930 | Levi |
| 2,102,310 | A | | 12/1937 | Egan |
| 2,615,526 | A | | 10/1952 | Lane |
| 4,419,232 | A | | 12/1983 | Arntyr et al. |
| 5,575,925 | A | | 11/1996 | Logue, Jr. |
| 6,045,691 | A | | 4/2000 | McDemott |
| 6,086,758 | A | * | 7/2000 | Schilling et al. ..... 210/164 |
| 6,106,707 | A | * | 8/2000 | Morris et al. ..... 210/163 |
| 6,149,803 | A | * | 11/2000 | DiLoreto, Jr. et al. ..... 210/164 |
| 6,178,565 | B1 | * | 1/2001 | Franco ..... 210/163 |
| 6,214,216 | B1 | * | 4/2001 | Isaacson ..... 42001/163 |
| 6,261,444 | B1 | * | 7/2001 | Forse ..... 210/164 |
| 6,274,036 | B1 | * | 8/2001 | Ellis ..... 210/164 |
| 6,294,095 | B1 | * | 9/2001 | Lewis ..... 210/164 |
| 2002/0113025 | A1 | * | 8/2002 | Gaudlin et al. ..... 210/163 |

OTHER PUBLICATIONS

Application #09/769,212 Filing date Jan. 25, 2001 GR PaArt Unit 1724 Catch basin filter John F. Harris & Ardle E. Page.

* cited by examiner

*Primary Examiner*—Christopher Upton

(57) ABSTRACT

The invention is a filter system and support structure for use with drain basins, which have a perforated cover and cover support ledges, comprising a bag assembly, which is used as the filter, support members, an overflow bypass, and a channel for directing water into the bag assembly. The invention lies directly on the ledges of the cover support and is sandwiched between said support ledges and said cover.

10 Claims, 2 Drawing Sheets

SUBGRATE DRAIN BASIN FILTER

CROSS-REFERENCE TO RELATED APPLICATIONS

Not applicable

STATEMENT REGARDING FEDERALLY SPONSORED RESEARCH

Not applicable

SEQUENCE LISTING

Not applicable

BACKGROUND OF THE INVENTION

1. Field of the Invention

This invention relates to a filter for use inside storm water inlet basins, beneath perforated covers such as perforated manhole receptacles and catch basins with grates.

2. Background-Description of Prior Art

Storm water collection systems are located throughout our city streets and parking lots providing flood control and drainage. The storm water needs to be as free as possible from pollutants before it enters our natural water systems such as streams. To ensure that our water sources are protected the handling of storm water is becoming more regulated. In order to meet these concerns, many inventions have been patented that provide an anti pollution support filter insert systems for catch basins and manholes. Most of these inventions are unnecessarily expensive.

Caldwell (U.S. Pat. No. 1,310,055) develops a storm water device to strain out large debris such as sticks and leaves and allows them to be broken up before passing down stream or be removed manually. This apparatus is ineffective in separating sand or small particulate such as cigarette filters from the storm water before flowing downstream from the opening.

A. Levy (U.S. Pat. No. 1,746,121) and George F. Egan (U.S. Pat. No. 2,102,310) show a receptacle for mounting below a storm water inlet. The large basket is constructed of metal. It is heavy and very complex. This would be very expensive to manufacture. They both require large equipment to install and maintain.

F. Lane (U.S. Pat. No. 2,615,526) shows a basket mounted entirely below a catch basin grate. It comprises a rigid metal frame for the basket, which is suspended from rods secured directly to the bottom of the grate. This would be very time consuming and awkward to install. A grate is already heavy and hard to handle. The frame when attached to the grate would be difficult to install without damaging the metal frame. Furthermore, its complexity makes it expensive to manufacture.

Oscar S. Arntyr et al. (U.S. Pat. No. 4,419,232) shows a double basket mounted entirely beneath a storm drain opening and grate. The device is unnecessarily complex. The initial top screen basket is unnecessary. It removes pollutants that would have been removed by the below second filter anyway. The second stage basket cannot be serviced or emptied by hand unless the whole frame is removed. The rigid frame cannot be easily adapted to the various sizes of grates or accommodate typical angular distortions. The frame with its descending circumference is unnecessarily complex and expensive to manufacture. There is no provision for a bypass to accommodate high flows or filter failure.

Logue, Jr. (U.S. Pat. No. 5,575,923) and John F. Harris et al. (U.S. patent application Ser. No. 09/769,212 Group Art unit 1724) show a basket essentially below the grate of a drain opening. A substantial amount of the apparatus extends above the grate. This can be a traffic hazard, and the apparatus would be vulnerable to wear and vandalism. Apparatus shown in Logue and Harris also do not provide an overflow bypass. Accordingly, during high storm water flows or filter failures these systems would cause water to back up onto the street.

Holly S. McDermott (U.S. Pat. No. 6,045,691) shows a receptacle entirely below a storm water inlet with a perforated cover. The receptacle, however, has limited pollutant storage capacity. McDermott discloses as system having four separate baskets, one on each corner, which would required time consuming manual cleaning as they are too small for being serviced by a typical large street vacuuming machine. Further, the fixed frame mounting does not easily adjust to the various distorted angles encountered in many rectangular storm water inlet openings. The drain basins are often out of square or of slightly different measurements than anticipated. The frame is unnecessarily expensive to manufacture. The pollutant sock is small in size and would quickly saturate, thereby becoming ineffective.

Accordingly, what is required is a new drain basin filter and accompanying support structure that have none of the above discussed disadvantages.

BRIEF SUMMARY OF THE INVENTION

The present invention solves the aforementioned and other problems by providing a filter with an accompanying support structure that is inexpensive to manufacture, easy to install remove, and simple to service.

Other features and advantages of the present invention will become apparent from a consideration of the drawings and ensuing descriptions.

DETAILED DESCRIPTION OF THE INVENTION

Figure 1:
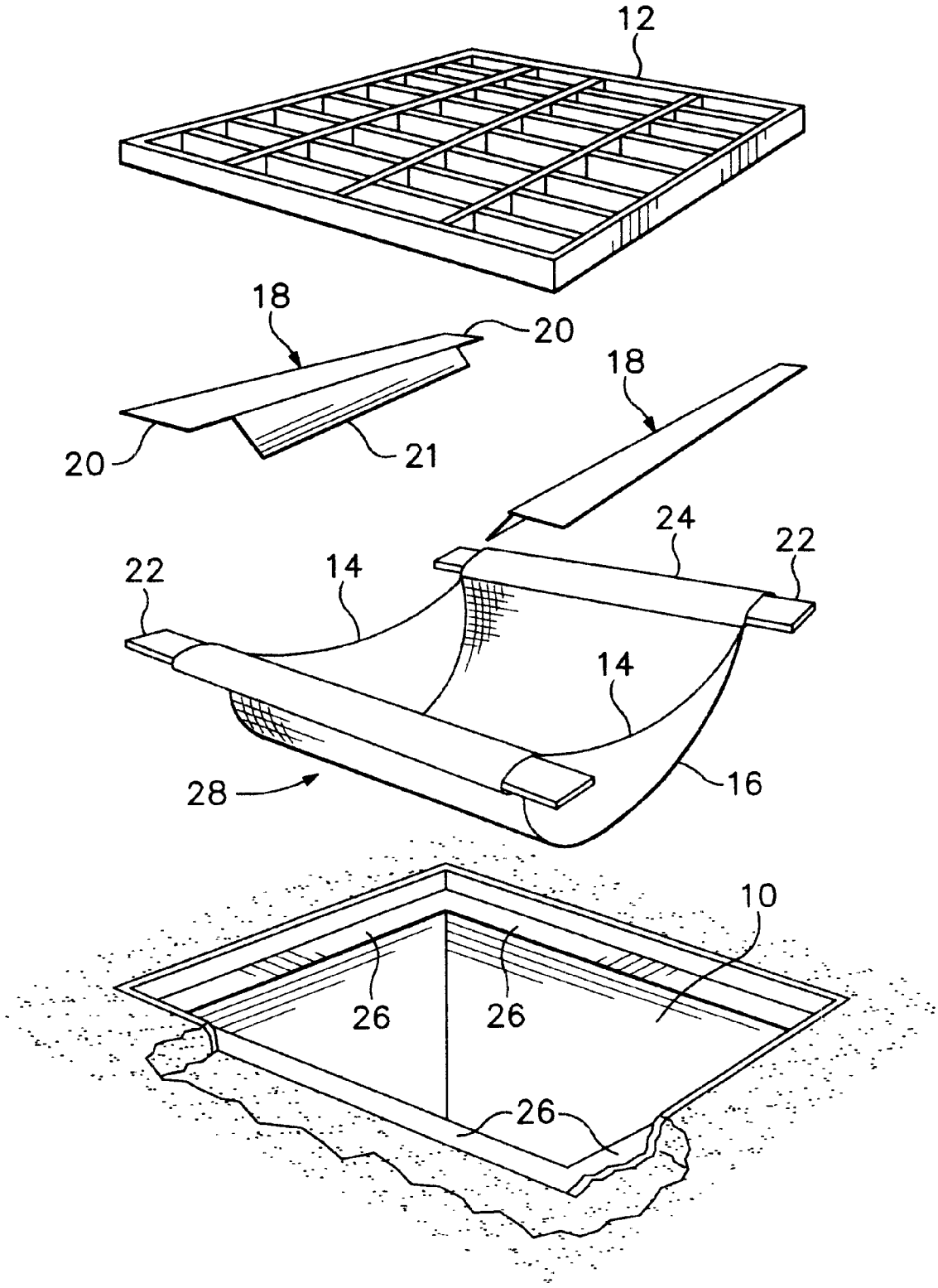
FIG. 1 is an exploded view of the components of a preferred embodiment of the invention for use in a rectangular drain basin.
Figure 2:
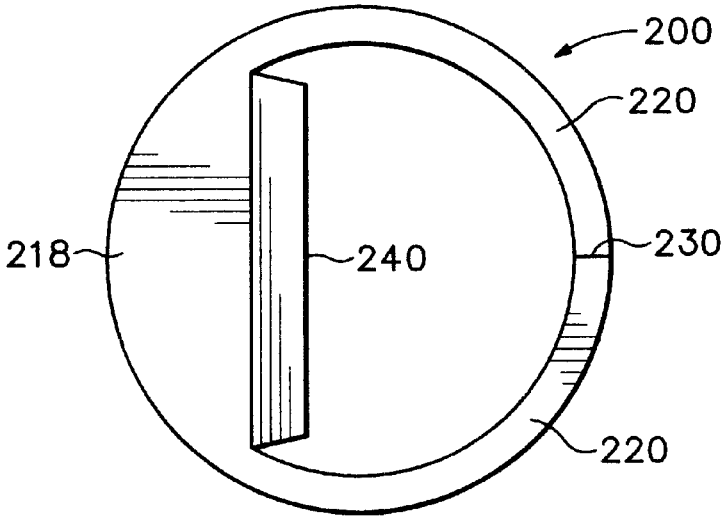
FIG. 2 is a top view of a component of the embodiment shown in FIG. 3.
Figure 3:
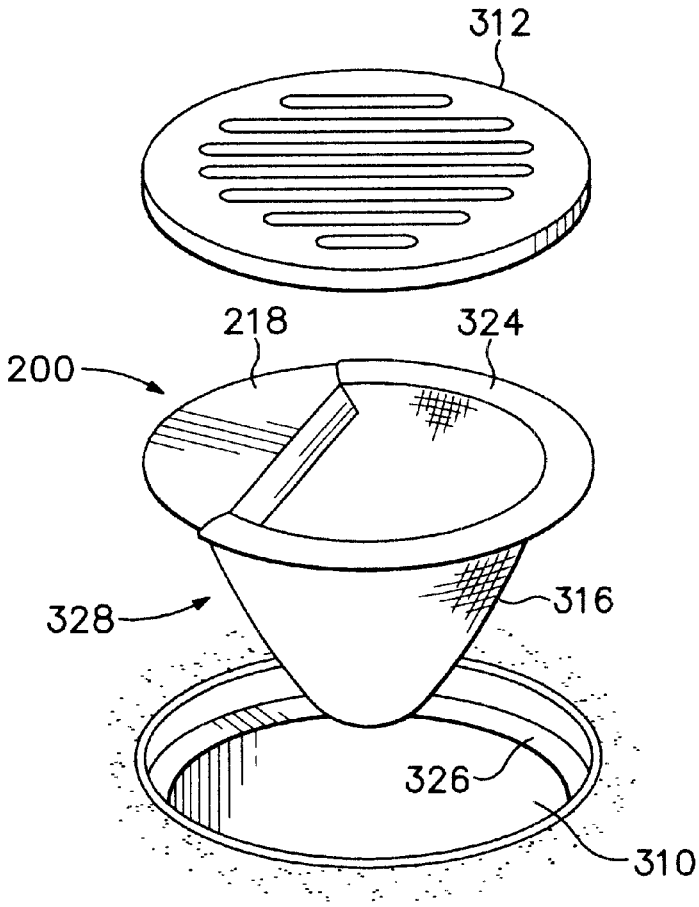
FIG. 3 is an exploded view of the components of another embodiment of the invention for use in a round drain basin.

FIG. 1 shows an exploded perspective of the invention in relation to its installed position in a typical rectangle inlet basin with a perforated cover 12. FIG. 2 shows a support structure of the invention for a round inlet basin. FIG. 3 shows an exploded perspective view of the invention and installation arrangement in a round inlet basin beneath a perforated cover.

In FIG. 1, a bag assembly 28 comprises a filter basket 16, two sleeves, 24, and a pair of drooping loops 14 located at the top peripheral portion of assembly 28. Sleeves 24 enclose two support members 22. Filter basket 28 is made of a porous material with hydraulic openings smaller than the pollutants intended to be filtered from the storm water. Bag assembly 28 is preferably made from a polypropylene geotextile fabric. However, this filter may be made of any type of porous materials for example, cotton, burlap, or stainless steel, fiberglass, and aluminum mesh. The filter basket is connected to the support structure by means of sleeves.

The support structure comprises support members 22 and bridge 18. The sleeves 24 receive the support members 22. The members stretch the sleeves across a portion of the inlet cover support 26. In most drain basins, the cover support commonly comprises a ledge as shown in the figures. However, other structures have been used as cover supports such as short steels rods or angle irons. The bag assembly's loops 14 droop lower than the level of the support members, thereby forming overflow bypasses. See FIG. 1. If overflow bypasses are not required, the remaining basin sides may be equipped with additional support members 22 inserted into additional sleeves 24. When assembled together, the two support members rest directly on the cover support ledges 26 with the distal ends of support members 22 resting generally in the corners of the basin support ledge 26. Support ledges 26 are typically about two inches wide. Support members 22 may be comprised of fourteen gage galvanized sheet metal two inches wide and about one inch shorter than the length of ledge 26 on which it rests. The support members 22 are intended to be placed between the cover support ledges 26 and perforated cover 12. In certain rectangular basins with only a single pair of opposing cover support ledges 26, a pair of support members 22 lay at a 90-degree angle relative to ledges 26. The ends of each bar extends onto each of the ledges. If additional strength is required, the support members may be of one-inch galvanized angle iron. The angle iron is notched out back about one and one-half inch on each end so as to rest flat on the two parallel ledges. The ends are then placed on the ledges and in a comer of the basin. Bridges 18 span across the remaining sides of the basin. Bridges 18 may be composed of 18 gage 50–52 aluminum sheet metal. Bridge 18 alternatively could comprise any other suitable metal or fabric. For example, bridge 18 can be made of the same material as filter basket 16. Bridge 18 could also be attached directly to the basket. In the embodiment shown in FIG. 1, bridge 18 comprises a pair of support flanges 20 and an incline ramp 21. Bridge 18 may be manufactured by bending a substantially rectangular piece of sheet metal in half, thereby forming a upper half and a lower half, the lower half is notched at each end about 1½ inch to form a pair of support flanges 20. Support flanges 20, rest on the top of sleeves 24, which enclosed support members 22, in the basin's corners. The remaining lower half 21 hangs between the two support members 22and extend into the cavity of filter basket 16.

In the embodiment shown in FIG. 2 and FIG. 3, support members and the bridge have been combined into a unified support structure 200 comprising a bridge portion 218 with incline ramp 240 and support arms 220. Support structure 200 may be made of of one piece of 14 gage 50–52 aluminum sheet metal. The perimeter of support structure 200 is circular and sized to fit within the inlet opening and rest to on cover support ledge 326. Support arms 220 separate at 230. Bag assembly 328 has a substantially circular top opening with a single sleeve 324 having two open ends. Sleeve 324 is mounted on to support structure 200 by inserting support arms 220 into sleeves 324. Like the embodiment shown in FIG. 1, the filter basket has a loop (not shown) between the two support arms underneath bridge incline ramp 240 to form a bypass channel. Incline ramp 240 is inclined downward covering the loop and extends into the center of the support structure.

The invention removes and retains storm water pollutants within a storm water inlet basin. Storm water flows from the street through the perforated cover. Then it flows either across the sleeve, in which the support member is inserted into, or across the bridge. The storm water then flows into the filter basket. The basket's filter material permits storm water to flow through the filter basket and into the basin chamber while retaining pollutants within the basket's cavity.

The invention is convenient to install. For example in the embodiment of FIG. 1, remove the perforated cover 12 insert two support members 22 into sleeves 24 of bag assembly 28, lay each sleeve 24 on cover support ledges 26 and replace cover 12. Where there are only two parallel cover support ledges, instead of one continuous ledge, place the sleeves with support bars inserted therein perpendicular to the two ledges resting the ends of the bars on the ledges in the basin corners. Place the bridges on the two remaining sides of the catch basin by laying bridge support flanges 20 on top of the bars in the basin corners. Incline ramp 21 should extend between the two bars and into the filter basket. Replace cover 12. The invention is removed in reverse order.

Installing the embodiment shown in FIG. 2 and FIG. 3 is also convenient. With incline ramp 240 extending downward, insert one arm 220 into one end of bag sleeve 324 and slide sleeve 324 around and up against the side of bridge 218. Insert the remaining arm 220 into the other opening of sleeve 324 and move that sleeve around to the other side of the bridge. Lay the assembled apparatus directly on top of support ledge 326. Replace the cover 312.

Servicing the filters is convenient. They can be either vacuumed or pulled out by hand and emptied.

Accordingly, this invention can remove pollutants from storm water within an inlet basin before the water is released down stream from the basin. It is economical to manufacture, install and service. In addition, as mentioned above a variety of filtering media can be used with this invention.

The description above should not be construed as limiting the scope of the invention but to merely provide examples of some of the embodiments of this invention. The scope of the invention should be determined by the appended claims and their legal equivalents, rather than by the examples given.

I claim:

1. In a storm water drain basin having an inlet grate cover, an inlet grate cover support on which the grate cover rests on, an inlet for fluid to flow into, a drain basin lower chamber, and a fluid outlet, a drain basin filter system comprising:

(a) a filter basket located below said basin inlet, said basket comprising a basket cavity and a periphery portion, said periphery portion comprising an upper portion, a sleeve and a loop having a top edge, said loop being formed in said upper portion, whereby said loops provides egress for fluid to flow over said top edge;

(b) an elongated support member, said support member being slidably inserted into said sleeve, thereby stretching said sleeve across said inlet grate cover support, wherein said sleeve and said support member rest directly on said inlet grate cover support; and (c) a bridge comprising a flange and an inclined ramp, said flange resting on top of said sleeve and said support member, whereby fluid may flow across said bridge and down said inclined ramp into said filter basket cavity.

2. The drain basin filter system of claim 1 wherein said filter basket is comprise of materials selected from the group consisting of polypropylene, cotton, burlap, stainless steel, fiberglass, and aluminum.

3. The drain basin filter system of claim 1, wherein said support members comprise steel rods.

4. A drain basin filter system for use within a storm water inlet basin, having a top opening and a perforated cover that rests on a cover support, comprising:

(a) a filter bag assembly located within said inlet basin and between said cover and said cover support, said bag assembly having a filter basket said basket having a basket cavity;

(b) a rigid support member attached to said assembly thereby restraining said assembly within said inlet basin;

(c) a loop formed in a peripheral portion of said filter bag assembly, said loop hanging lower than said rigid support member, whereby said loop provides a channel for excess fluid to flow out of said basket cavity; and (d) a bridge member located directly above said loop, whereby said bridge member conveys fluid from said drain basin's top opening into said basket cavity.

5. The drain filter system of claim 4, wherein said bridge member comprises aluminum sheet metal.

6. The drain filter system of claim 4, wherein said support member comprises an elongated rigid support member that is inserted into a sleeve, said sleeve being located on the periphery of said filter bag assembly, thereby stretching said sleeve across a portion of said basin's perforated cover support structure restraining said filter bag assembly in position within said basin.

7. The drain filter system of claim 6, wherein said support member comprises a first arm and a second arm, said arms being joined to and extending from said bridge member, whereby said arms are slidably inserted into said sleeve.

8. The drain filter system of claim 7, wherein said arms and said bridge substantially form a circular shape, and wherein said sleeve comprises a first open end and a second open end, whereby said first arm is inserted into said sleeve's first open end and said second arm is inserted into said sleeve's second open end.

9. A method to filter fluid entering a drain water basin having a perforated cover, a cover support, a basin cavity, comprising the steps of:

(a) removing said cover (b) inserting a support member into a sleeve of a bag assembly, said bag assembly comprising said sleeve, an upper periphery portion, said periphery portion having a loop;

(c) lowering said bag assembly into said basin cavity;

(d) placing said sleeve with said support member inserted therein on said cover support;

(e) placing a bridge member across the opening of said inlet basin, whereby said bridge member is located above said loop;

(e) replacing said perforated cover; and (f) allowing fluid to enter said bag assembly through said perforated cover, wherein said bridge conveys fluid over said loop and into said bag, and said loop forms an overflow bypass.

10. The method of claim 9, wherein said cover support comprises a pair of a parallel ledges, the act of placing said sleeve with said support member inserted therein on said cover support further comprising placing the ends of a pair of elongate support members perpendicular to said pair of parallel ledges, whereby said ends rest on said parallel ledges.

* * * * *